US005314126A

United States Patent [19]

Alvarez

[11] Patent Number: 5,314,126

[45] Date of Patent: May 24, 1994

[54] HAMMER MILL APPARATUS

[76] Inventor: Oscar E. Alvarez, Apr. 701, 5700 Mariner South, Tampa, Fla. 33609

[21] Appl. No.: 52,566

[22] Filed: Apr. 26, 1993

Related U.S. Application Data

[63] Continuation-in-part of Ser. No. 833,792, Feb. 12, 1992, Pat. No. 5,205,501.

[51] Int. Cl.[5] ..... B02C 13/04; B02C 13/26

[52] U.S. Cl. ..... 241/189.1

[58] Field of Search ..... 241/138, 154, 189.1, 241/194

[56] References Cited

U.S. PATENT DOCUMENTS

| | | | |
|---|---|---|---|
| 2,152,108 | 3/1925 | Tice | 241/194 X |
| 3,098,613 | 7/1963 | Hellyer | 241/194 X |
| 3,946,950 | 3/1976 | Graf | 241/198.1 X |

*Primary Examiner*—Douglas D. Watts

*Attorney, Agent, or Firm*—Arthur W. Fisher, III

[57] ABSTRACT

A hammer mill apparatus to shred and chip boards fed therethrough comprising a shredding rotor assembly rotatably disposed within a debris chamber formed within a rotor housing including an entry portion and an exit portion formed therein, the shredding rotor assembly includes at least one rotor disc assembly having a plurality of hammer elements pivotally coupled to the periphery thereof being operatively connected to a rotor drive assembly including a drive motor and a rotatable rotor drive shaft to rotate the rotor disc assembly exerting centrifugal force on the plurality of hammer elements such that a line coincident with the longitudinal axis of each hammer element extends through the rotatable rotor drive shaft whereby the outer end of the hammer elements engage boards in the entry portion to shred and chip such boards entering the debris chamber and discharges the reduced material from the exit portion.

22 Claims, 7 Drawing Sheets

HAMMER MILL APPARATUS

CROSS-REFERENCE

This is a continuation-in-part application of pending U.S. application Ser. No. 833,792 filed Feb. 12, 1992, now U.S. Pat. No. 5,205,501.

BACKGROUND OF THE INVENTION

1. Field of the Invention

A hammer mill apparatus to shred and chip boards fed therethrough.

2. Description of the Prior Art

Numerous devices have been developed to chip, shred, mulch and otherwise reduce wood, branches, limbs, leaves and the like.

U.S. Pat. No. 4,824,034 shows an apparatus for shredding branches, limbs, twigs, leaves or like material including a housing having a rotatable shredding mechanism disposed in the lower portion thereof including a plurality of pivotally mounted substantially triangular shaped hammers for shredding material within the cavity.

U.S. Pat. No. 3,724,767 discloses a chipper comprising a housing to support a feed roll positioned above a guide chute extending to a rotor having a series of axially spaced circular rotor plates rigidly secured to a driven rotor with a series of peripherally spaced shaft members extending axially through segments of the rotor plates and a plurality of hammer elements mounted on each shaft member between the rotor plates for full 360 degree rotation.

U.S. Pat. No. 3,627,212 teaches a hammer hog to reduce various materials into different sizes including a hinged housing top having a rotatable assembly of hammers and/or impactors disposed therein.

U.S. Pat. No. 3,674,220 shows a chipping knife and shredder flails mounted for rotation about a common axis.

U.S. Pat. No. 2,856,134 discloses a soil pulverizer and horticultural hammer mill comprising a housing having a material feeding hopper opening through one wall thereof and at least one discharge therefrom, a rotor mounted for rotation in the housing and having a plurality of rows of blades each pivotally supported on axes parallel to the rotor axis.

U.S. Pat. No. 3,946,950 shows a material reducer for coal and the like comprising rotary hammers, bars or the like to crush the material and to propel the crushed material upwardly along a confined or partially confined path which discharges onto an output conveyor or directly to a screen or other processing equipment.

U.S. Pat. No. 4,030,865 teaches an apparatus to defiberize waste paper stock and uniform dispersion and accumulation the defiberized fine fiber stock for dry web formation comprising a defiberizing drum having cylindrical teeth formed on the inside circumferential plane and an outlet for delivery of the defiberized fine stock formed of this lower portion, a hollow rotary shaft provided rotatably in the defiberizing drum, a multitude of swing hammers provided swingably around the hollow rotary shaft both circumferentially and axially at respectively regular intervals.

U.S. Pat. No. 4,558,826 discloses a hammer comprising a hammer body with a substantially bell-shaped profile having a larger end and sides converging to a smaller end with front and back faces that are substantially flat. A large mounting bore extends through the body to receive a pivot shaft from which the hammer may pivotally swing.

East German 243,219 shows a cutter bar for a hammer-type crusher movable in the horizontal direction in a guide in a crusher housing having a spindle mechanism therein coupled to an indexing electric motor.

SUMMARY OF THE INVENTION

The present invention relates to a hammer mill apparatus to shred and chip boards fed therethrough. Specifically, the hammer mill apparatus comprises a shredding rotor assembly rotatably disposed within a rotor housing operatively supported on a frame.

The rotor housing comprises a debris chamber having an entry portion and an exit portion formed on opposite sides thereof to feed boards to the debris chamber and discharge debris therefrom. The entry portion comprises an entry chute having an inlet opening to receive boards therethrough; while, the exit portion comprises an exit chute having an outlet opening to discharge debris therefrom. The debris chamber includes a chamber inlet disposed adjacent the inner end of the entry chute and a chamber outlet disposed adjacent the inner end of the exit chute. An anvil assembly is disposed adjacent the chamber inlet to cooperate with the shredding rotor assembly to shred and chip boards entering the debris chamber as described more fully hereinafter.

The shredding rotor assembly comprises a plurality of rotor disc assemblies each including a plurality of hammer elements pivotally coupled to the periphery thereof. The plurality of rotor disc assemblies are operatively coupled to a rotor drive assembly including a drive motor by a rotatable rotor drive shaft to rotate the plurality of rotor disc assemblies to exert centrifugal force on the plurality of hammer elements such that a line coincident with the longitudinal axis of each hammer element extends through the rotatable rotor drive shaft.

In operation, the rotor shredding assembly is rotated at substantially 1200 revolutions per minute. As boards are fed through the entry chute, the rotating hammer elements and anvil assembly cooperatively shred or chip the boards at the inner end of the entry chute drawing the debris into the debris chamber through the debris chamber inlet, through the debris chamber and discharged through the debris chamber outlet and exit chute. The debris may then be collected in a separate hopper.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
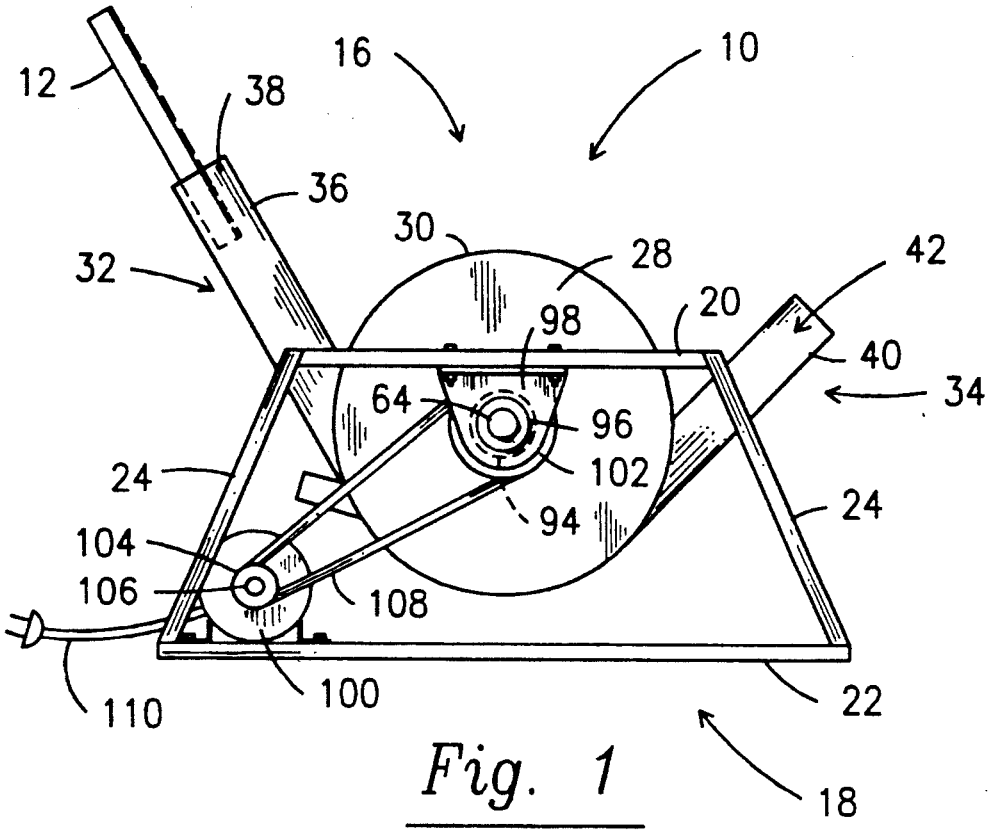
FIG. 1 is a side view of the hammer mill apparatus.
Figure 2:
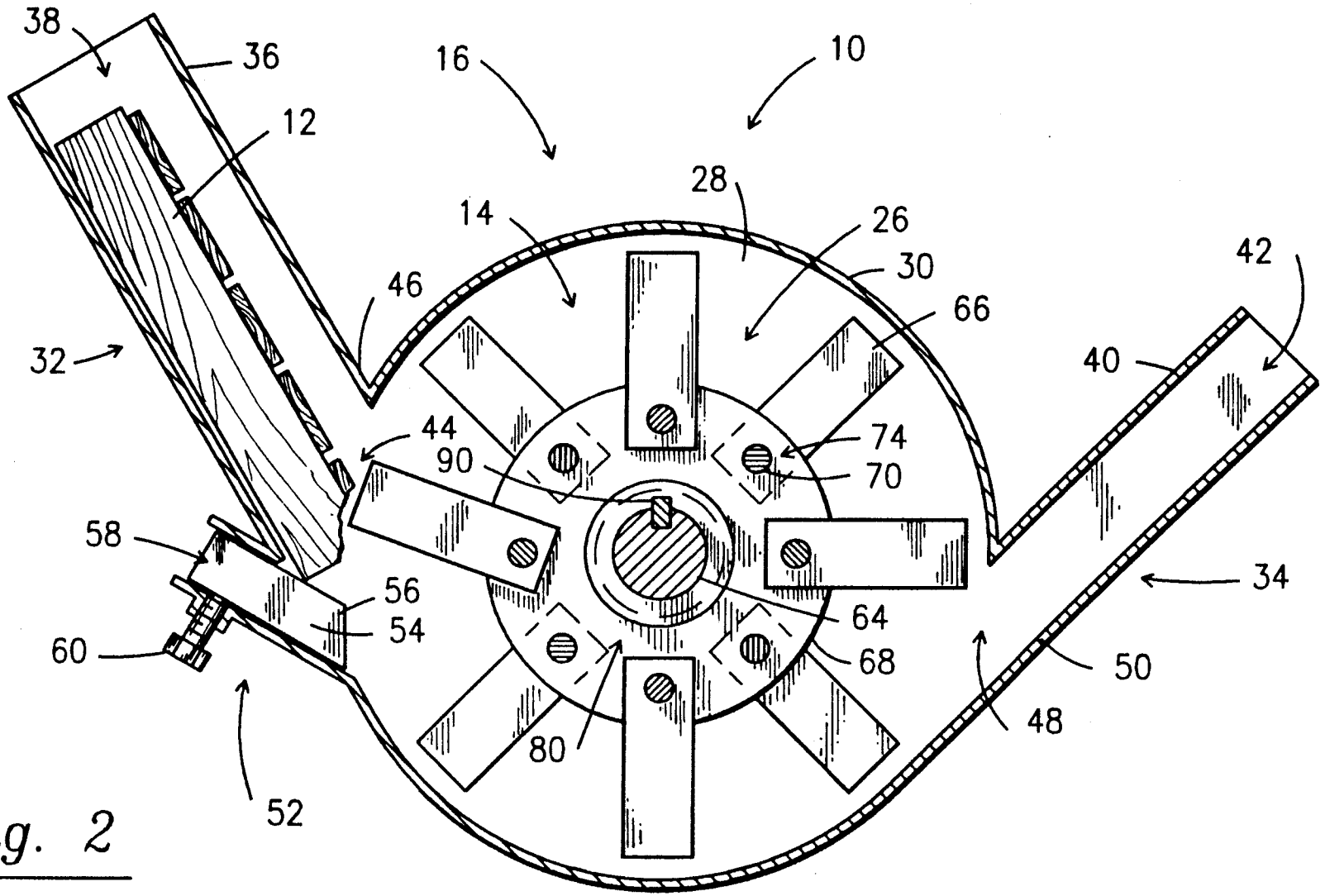
FIG. 2 is a cross-sectional side view of the housing and shredding rotor assembly of the hammer mill apparatus.

As best shown in FIGS. 1 and 2, the present invention relates to a hammer mill apparatus generally indicated as 10 to shred or chip pallets 12 having nails and the like. Specifically, the hammer mill apparatus 10 comprises a shredding rotor assembly generally indicated as 14 rotatably disposed within a rotor housing generally indicated as 16 supported on a frame generally indicated as 18.

As shown in FIG. 1, the frame 18 comprises a pair of substantially horizontal rotor housing support members 20 disposed on opposite ends of the rotor housing 16 held in fixed spaced relationship relative to a base 22 by a plurality of upright frame members each indicated as 24.

As shown in FIGS. 1 and 2, the rotor housing 16 comprises a debris chamber 26 cooperatively formed by a pair of end plates 28 disposed on opposite ends of a substantially cylindrical shell 30.

As shown in FIGS. 1 and 2, an entry portion generally indicated as 32 and an exit portion generally indicated as 34 are disposed on opposite sides of the debris chamber 26 to feed pallets 12 thereto and discharge debris therefrom as described more fully hereinafter. The entry portion 32 comprises an entry chute 36 having an inlet opening 38 to receive pallets 12 therethrough; while, the exit portion 34 comprises an exit chute 40 having an outlet opening 42 to discharge debris therefrom.

As shown in FIG. 2, the debris chamber 26 further includes a chamber inlet 44 formed in the substantially cylindrical shell 30 adjacent the inner end 46 of the entry chute 36 and a chamber outlet 48 formed in the substantially cylindrical shell 30 adjacent the inner end 50 of the exit chute 40.

As shown in FIG. 2, an anvil assembly generally indicated as 52 is disposed adjacent the chamber inlet 44 to cooperate with the shredding rotor assembly 14 to shred and chip pallets 12 entering the debris chamber 26 as described more fully hereinafter. The anvil assembly 52 comprises an anvil element 54 substantially the width of the substantially cylindrical shell 30 including an inclined anvil surface 56 slidably disposed within an anvil channel 58 formed on the substantially cylindrical shell 30. The anvil element 54 is adjustable longitudinally within the anvil channel 58 to vary the distance between the inclined anvil surface 56 and shredding rotor assembly 14. The anvil element 54 is selectively secured within the anvil channel 58 by a fastening means 60.

As shown in FIGS. 1 and 2, the longitudinal axes of the entry chute 32 and exit chute 34 form angles of 60 degrees and 45 degrees respectively relative the horizontal plane.

Figure 3:
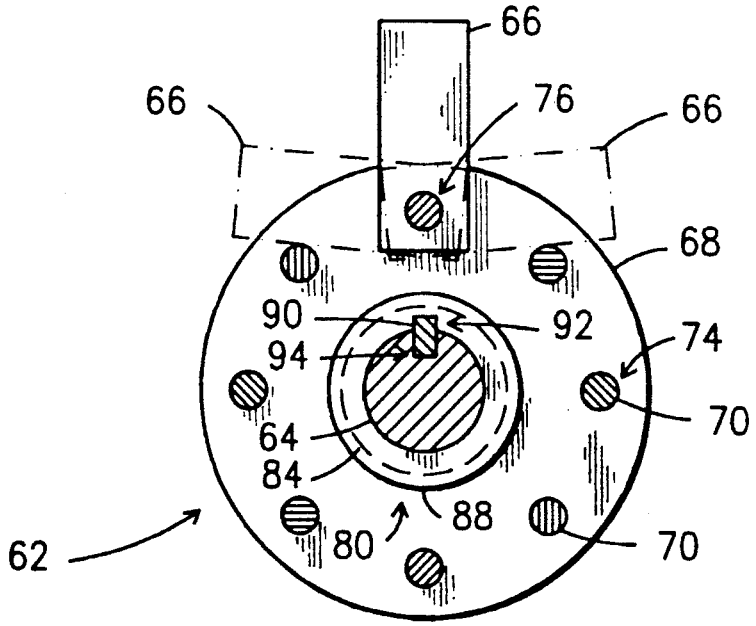
FIG. 3 is a partial side view of the shredding rotor assembly.
Figure 4:
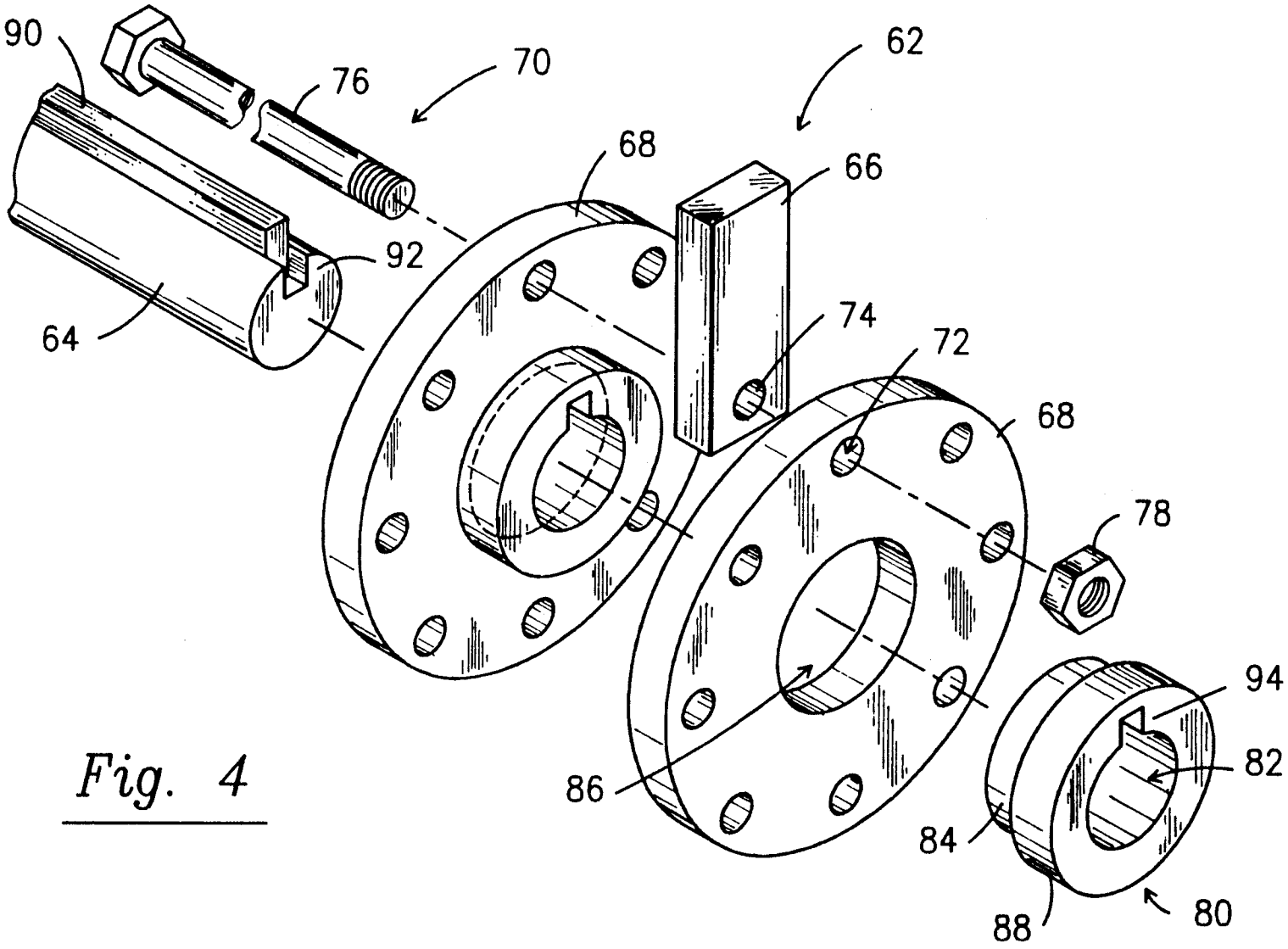
FIG. 4 is an exploded partial isometric view of the shredding rotor assembly.

As shown in FIGS. 2 through 4, the shredding rotor assembly 14 comprises a plurality of rotor disc assemblies each generally indicated as 62 operatively mounted on a rotatable rotor drive shaft 64. Each rotor disc assembly 62 comprises a plurality of hammer elements each indicated as 66 pivotally mounted to the periphery of a pair of substantially parallel, spaced apart circular rotor discs each indicated as 68 by a corresponding pivot element indicated as 70 extending through a corresponding rotor disc aperture 72 and a hammer element aperture 74. The pivot element 70 may comprise a threaded bolt 76 and nut 78 combination or suitable alternative.

As best shown in FIG. 4, each circular rotor disc 68 is mounted on the rotatable rotor drive shaft 64 by a corresponding mounting collar generally indicated as 80 having a centrally disposed aperture 82 formed therethrough to receive the rotatable rotor drive shaft 64. Each mounting collar 80 comprises a substantially circular mounting element 84 affixed within a corresponding centrally disposed rotor disc aperture 86 and a substantially circular spacer element 88 having a width slightly greater than the width of the hammer elements 66. The rotor disc assemblies 62 are maintained in operative alignment relative to each other by a key 90 affixed within a slot 92 formed on the rotatable rotor drive shaft 64 extending through key way 94 formed in the periphery of the substantially circular spacer elements 88 to cooperatively form a rotor disc alignment means.

As shown in FIG. 2, the shredding rotor assembly 14 preferably comprises at least two rotor disc assemblies 62 each including four hammer elements 66 symmetrically disposed on the corresponding circular rotor disc 68. As shown, the hammer elements 66 of adjacent rotor disc assemblies 62 are off-set relative to each other. In this configuration, the hammer elements 66 are restricted to pivotal movement within an arc of substantially 180 degrees by the next adjacent pivot elements 70.

As shown in FIG. 1, the ortatably rotor drive shaft 64 extends through bearings 94 mounted to end plates 28 and bearing 96 mounted to mounting brackets 98 attached to the substantially horizontal rotor housing supports 20. A rotor drive assembly including a drive motor 100 mounted to the base 22 is operatively coupled to the rotatable rotor drive shaft 64 by a drive pulley 102 mounted thereon and drive pulley 104 mounted on an output drive shaft 106 having a drive belt 108 extending therebetween. The drive motor 100 is coupled to an electrical source (not shown) by conductor 110. Alternately a gasoline engine may be used.

In operation, the rotor shredding assembly 14 is rotated at substantially 1200 revolutions per minute. As pallets 12 are fed through the entry chute 36, the rotating hammer elements 66 and anvil assembly 52 cooperatively shred or chip the pallets 12 at the inner end 46 of the entry chute 36 drawing the debris into the debris chamber 26 through the chamber inlet 44, through the debris chamber 26 and discharged through the chamber outlet 48 and exit chute 40. The debris may then be collected in a separate hopper (not shown) Since the anvil element 54 is adjustable within the anvil channel 58, the distance between the outer ends of the rotating hammer elements 66 and inclined anvil surface 56 may be adjusted to determine the size of the debris.

Figure 5:
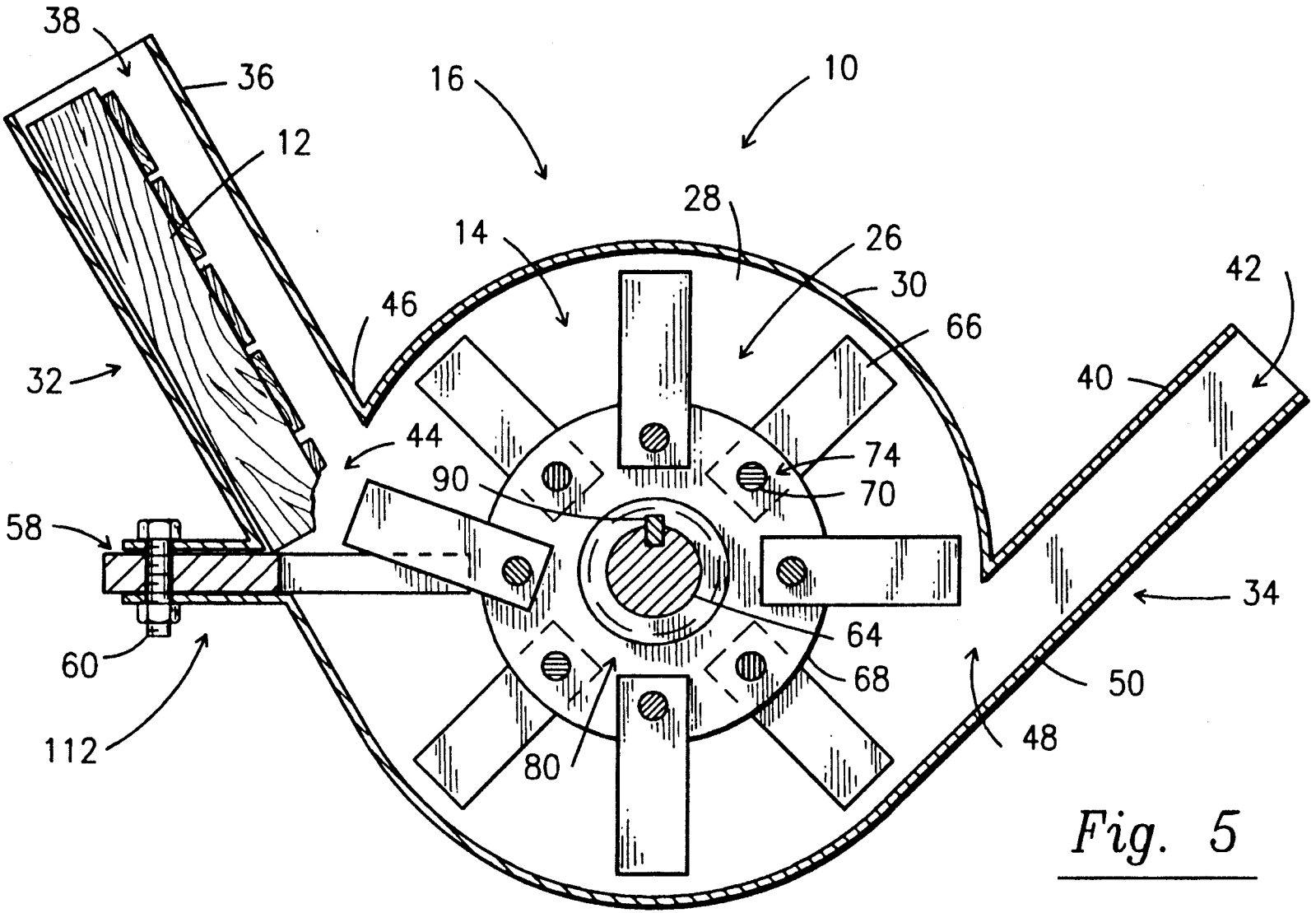
FIG. 5 is a cross-sectional side view of the housing and shredding rotor assembly of the hammer mill apparatus within an alternate anvil assembly.
Figure 6:
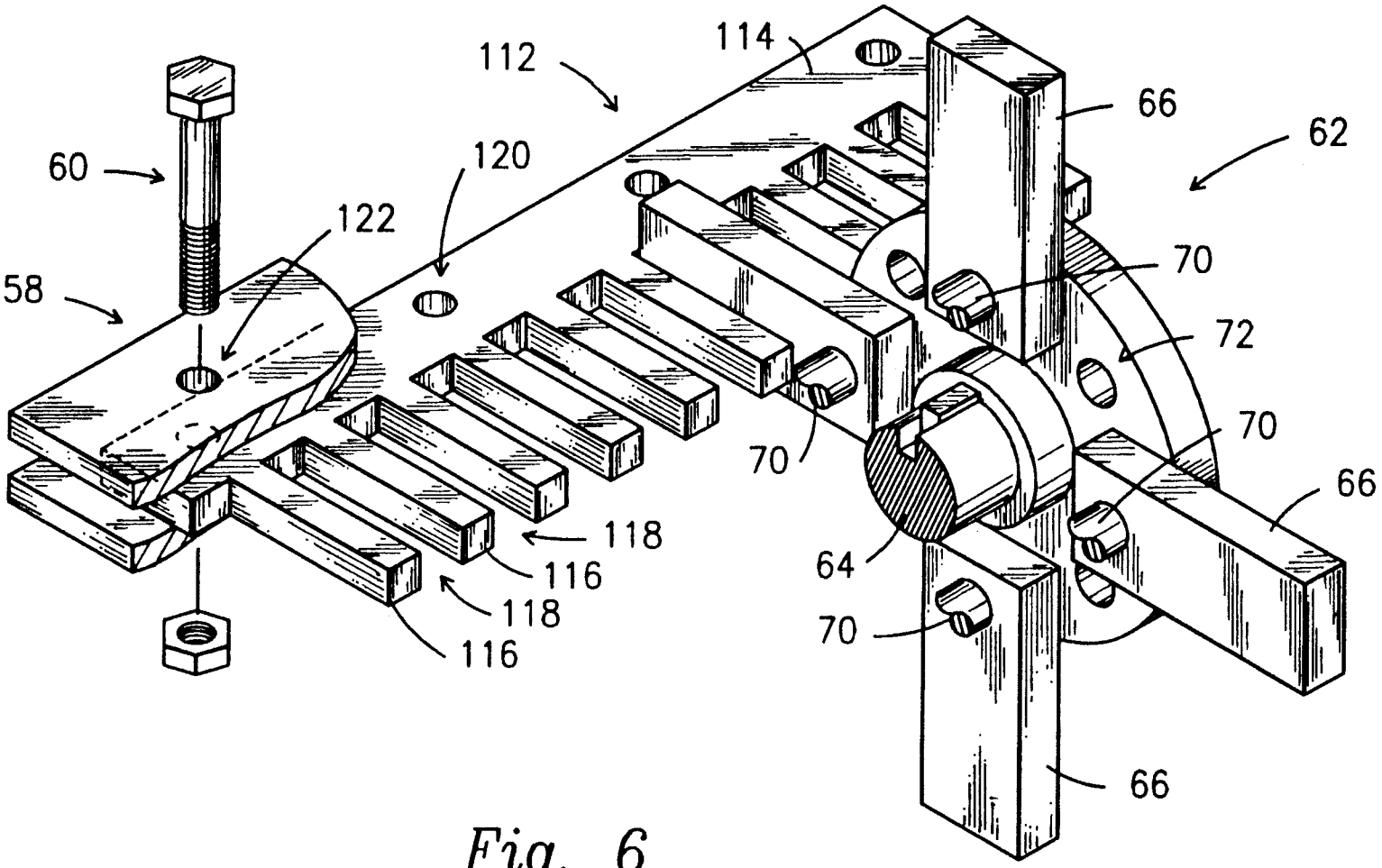
FIG. 6 is a partial isometric view of the alternate anvil assembly and a rotor disc assembly.

FIGS. 5 and 6 show an alternate embodiment of the anvil assembly generally indicated as 112. The anvil assembly 112 comprises an anvil element 114 substantially the width of the substantially cylindrical shell 30 having a plurality of spaced apart anvil elements each indicated as 116 extending outwardly therefrom to cooperatively form hammer element spacer 118 between adjacent anvil elements 116. The anvil element 114 is selectively secured within the anvil channel 58 by a fastening means 60 extending through apertures 120 and 122 formed on the anvil element 114 and channel 58 respectively.

As best shown in FIG. 6, the plurality of hammer elements 66 of the rotor disc assembly 62 corresponding to each hammer element space 118 are aligned to pass therethrough upon rotation of the rotor shredding assembly 14 otherwise the operation is the same as the embodiment shown in FIGS. 1 through 4. The longitudinal center line of the anvil elements are aligned with the rotor drive shaft 64.

Figure 7:
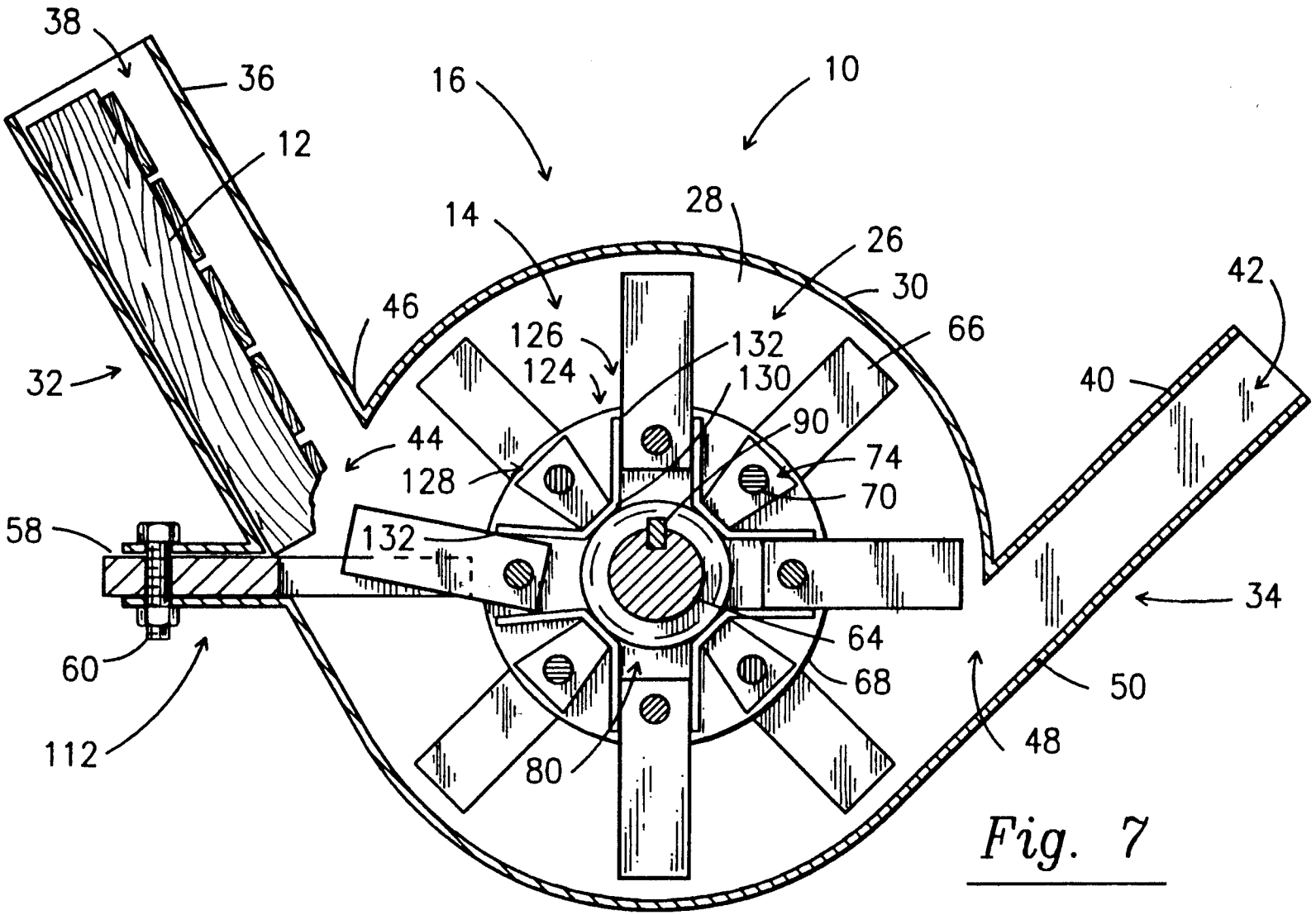
FIG. 7 is a cross-sectional side view of the housing and shredding rotor assembly of the hammer mill apparatus with a hammer element control means.

As shown in FIG. 7, the hammer mill apparatus 10 may further include a plurality of hammer element control means each generally indicated as 124 corresponding to each hammer element 66 to limit the pivotal movement thereof. Each hammer element control means 124 comprises a hammer element engagement means generally indicated as 126 to engage the sides adjacent hammer elements 66 of each rotor disc assembly 62 to limit the movement thereof secured in place by a corresponding securing member 128 mounted on the corresponding pivot element 70. Each hammer element engagement means 126 comprises an interconnecting base member 130 pressed against the periphery of the substantially circular spacer element 88 having a resilient limit member 132 inclined on opposite ends thereof to engage the hammer element 66.

Figure 8:
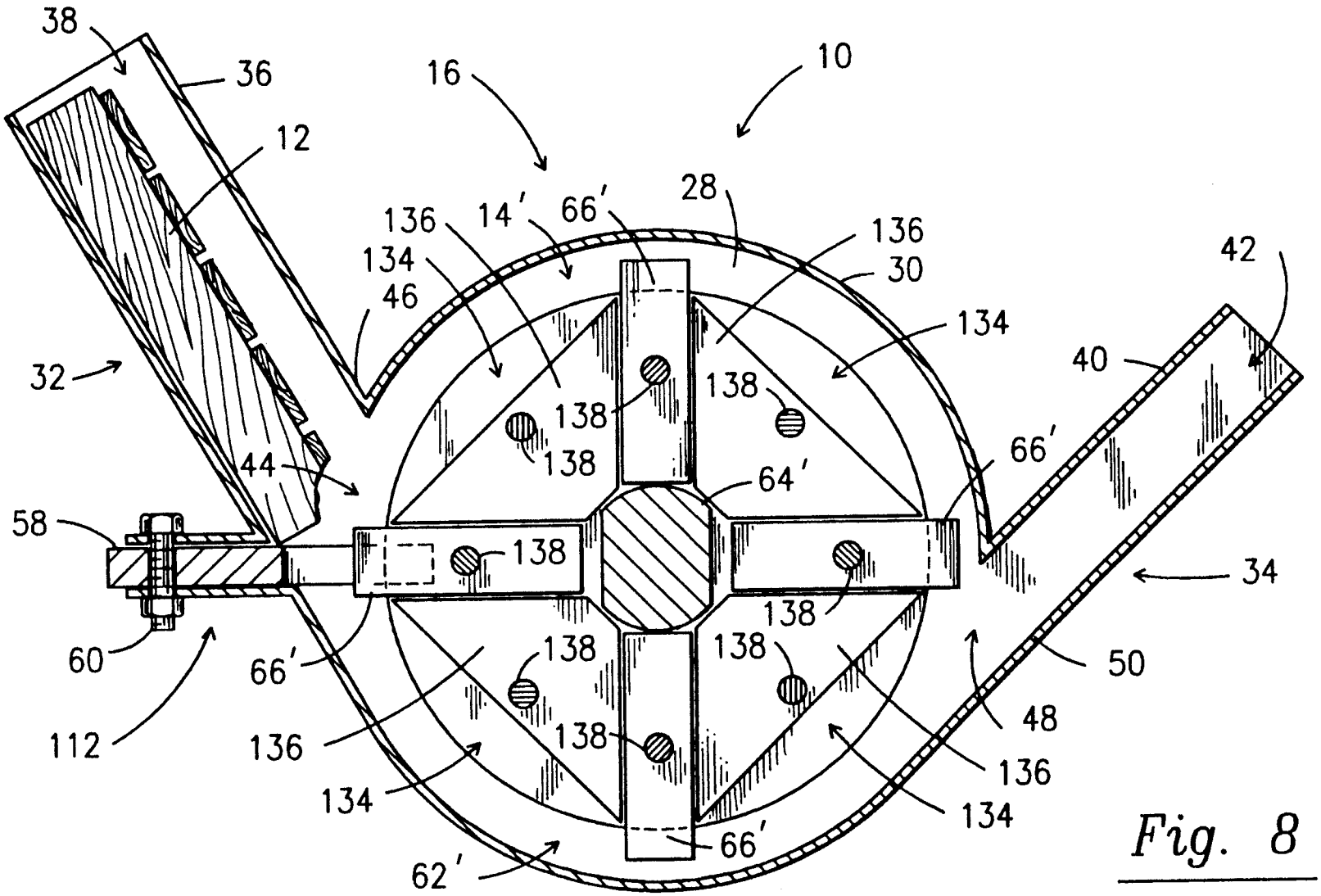
FIG. 8 is a cross-sectional side view of the housing and alternate embodiment of the shredding rotor assembly of the hammer mill apparatus.

FIG. 8 shows the hammer mill apparatus 10 with a plurality of alternative hammer element control means each generally indicated as 134 to limit the pivotal movement of each hammer element. Each hammer element control means 134 comprises a truncated triangularly shaped hammer element engagement means 136 to engage the sides of adjacent hammer elements 66' of each rotor disc assembly 62' to limit the movement thereof secured in place by a corresponding securing member 136 mounted on the corresponding circular rotor disc 68'. Of course, each hammer element engagement means 136 may be mounted on the corresponding circular rotor disc 68 by the pivot element 70 extending through the hammer element 66' aligned therewith from the next adjacent rotor disc assembly 62.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A hammer mill apparatus to shred and chip pallets fed therethrough comprising a shredding rotor assembly rotatably disposed within a rotor housing including an entry portion and an exit portion formed therein, said shredding rotor assembly includes at least one rotor disc assembly having a plurality of hammer elements pivotally coupled to the periphery thereof being operatively connected to a rotor drive assembly and a corresponding plurality of hammer element control means each comprising a truncated triangularly shaped hammer element engagement means wherein each said hammer element control means is disposed in spaced relationship relative to the next adjacent hammer element control means to receive one of said hammer elements therebetween such that opposite sides thereof are disposed to engage the sides of adjacent hammer elements to limit the pivotal movement thereof, said rotor drive assembly including a drive motor and a rotatable rotor drive shaft to rotate said rotor disc assembly exerting centrifugal force on each plurality of hammer elements such that a line coincident with the longitudinal axis of each said hammer element extends through said rotatable rotor drive shaft whereby the outer end of each said hammer element engages pallets in said entry portion to shred and chip such pallets entering said rotor housing and discharges the reduced material from said exit portion.

2. The hammer mill apparatus of claim 1 wherein said rotor housing comprises a debris chamber cooperatively formed by a pair of end plates disposed on opposite ends of a substantially cylindrical shell.

3. The hammer mill apparatus of claim 2 wherein said entry portion and said exit portion are disposed on opposite sides of said debris chamber to feed pallets thereto and discharge debris therefrom.

4. The hammer mill apparatus of claim 3 wherein said entry portion comprises an entry chute having an inlet opening to receive pallets therethrough and said exit portion comprises an exit chute having an outlet opening to discharge debris therefrom.

5. The hammer mill apparatus of claim 4 wherein said debris chamber further includes a chamber inlet formed in said substantially cylindrical shell adjacent the inner end of said entry chute and a chamber outlet formed in said substantially cylindrical shell adjacent the inner end of said exit chute.

6. The hammer mill apparatus of claim 5 further includes an anvil assembly disposed adjacent said chamber inlet to cooperate with said shredding rotor assembly to shred and chip pallets entering said debris chamber.

7. The hammer mill apparatus of claim 6 wherein said anvil assembly comprises an anvil element substantially the width of said substantially cylindrical shell including an inclined anvil surface slidably disposed with an anvil channel formed on said substantially cylindrical shell, said anvil element being adjustable longitudinally within said anvil channel to vary the distance between said inclined anvil surface and the outer ends of said hammer elements to control the space therebetween.

8. The hammer mill apparatus of claim 7 wherein the longitudinal axes of said entry chute and said exit chute form angles of 60 degrees and 45 degrees respectively relative the horizontal plane.

9. The hammer mill apparatus of claim 1 further includes at least two said rotor disc assemblies wherein each said rotor disc assembly comprises a plurality of hammer elements pivotally mounted to the periphery of a pair of substantially parallel, spaced apart circular rotor discs by a corresponding rotor disc aperture and hammer element aperture.

10. The hammer mill apparatus of claim 9 wherein each said circular rotor disc is mounted on said rotatable rotor drive shaft by a corresponding mounting collar having a centrally disposed aperture formed therethrough to receive said rotatable rotor drive shaft.

11. The hammer mill apparatus of claim 10 wherein each said mounting collar comprises a mounting element affixed within a corresponding centrally disposed rotor disc aperture and a spacer element having a width slightly greater than the width of said hammer elements.

12. The hammer mill apparatus of claim 11 wherein said rotor disc assemblies are maintained in operative alignment relative to each other by a key affixed within a slot formed on said rotatable rotor drive shaft extending through key ways formed in the periphery of said spacer elements to cooperatively form a rotor disc alignment means.

13. The hammer mill apparatus of claim 12 wherein said hammer elements of adjacent rotor disc assemblies are off-set relative to each other.

14. The hammer mill apparatus of claim 6 wherein said anvil assembly comprises an anvil element substantially the width of said shell having a plurality of spaced apart anvil elements extending outwardly therefrom to cooperatively form a hammer element spacer between adjacent anvil elements such that said plurality of hammer elements of said rotor disc assemblies corresponding to each said hammer element spacer are aligned to pass therethrough upon rotation of said rotor shredding assembly.

15. The hammer mill apparatus of claim 1 wherein the longitudinal center line of each said anvil element is aligned with said rotor drive shaft.

16. A hammer mill apparatus to shred and chip pallets fed therethrough comprising a shredding rotor assembly rotatably disposed within a rotor housing including an entry portion and an exit portion formed therein and a debris chamber cooperatively formed by a pair of end plates disposed on opposite ends of a substantially cylindrical shell, said entry portion and exit portion disposed on opposite sides of said debris chamber to feed pallets thereto and discharge debris therefrom, said entry portion comprising an entry chute having an inlet opening to receive palets therethrough and said exit portion comprising an exit chute having an outlet opening to discharge debris therefrom, said debris chamber further includes a chamber inlet formed in said substantially cylindrical shell adjacent the inner end of said entry chute and a chamber outlet formed in said substantially cylindrical shell adjacent the inner end of said entry chute and a chamber outlet formed in said substantially cylindrical shell adjacent the inner end of said exit chute, said shredding rotor assembly includes at least one rotor disc assembly having a plurality of hammer elements pivotally coupled to the periphery thereof being operatively connected to a rotor drive assembly and a plurality of hammer element control means each comprising a truncated triangularly shaped hammer element engagement means disposed to engage the sides of adjacent hammer elements to limit the pivotal movement thereof, an anvil assembly disposed adjacent said chamber inlet to cooperate with said shredding rotor assembly to shred and chip pallets entering said debris chamber, said anvil assembly comprising an anvil element substantially the width of said substantially cylindrical shell including an inclined anvil surface slidably disposed with an anvil channel to vary the distance between said inclined anvil surface and the outer ends of said hammer elements to control the space therebetween, said rotor drive assembly including a drive motor and a rotatable rotor drive shaft to rotate said rotor disc assembly exerting centrifugal force on each said plurality of hammer elements such that a line coincident with the longitudinal axis of each said hammer element extends through said rotatable rotor drive shaft whereby the outer end of each said hammer element engages pallets in said entry portion to shred and chip such pallets entering said rotor housing and discharges the reduced material from said exit portion.

17. The hammer mill apparatus of claim 16 wherein the longitudinal axes of said entry chute and said exit chute form angles of 60 degrees and 45 degrees respectively.

18. The hammer mill apparatus of claim 16 wherein said anvil assembly comprises an anvil element substantially the width of said shell having a plurality of spaced apart anvil elements extending outwardly therefrom to cooperatively form a hammer element spacer between adjacent anvil element such that said plurality of hammer elements of said rotor disc assemblies corresponding to each said hammer element spacer are aligned to pass therethrough upon rotation of said rotor shredding assembly.

19. The hammer mill apparatus of claim 16 wherein the longitudinal center line of each said anvil element is aligned with said rotor drive shaft.

20. The hammer mill apparatus to shred and chip pallets fed therethrough comprising a shredding rotor assembly rotatably disposed within a rotor housing including an entry portion and an exit portion formed therein, said shredding rotor assembly including at least two rotor disc assemblies wherein each said rotor disc assembly comprises a plurality of hammer elements pivotally mounted to the periphery of a pair of substantially parallel, spaced apart circular rotor discs by a corresponding rotor disc aperture and hammer element aperture being operatively connected to a rotor drive assembly and a plurality of hammer element control means each comprising a truncated triangularly shaped hammer element engagement means disposed to engage the sides of adjacent hammer elements to limit the pivotal movement thereof, said rotor drive assembly including a drive motor and a rotatable rotor drive shaft to rotate said rotor disc assembly exerting centrifugal force on each said plurality of hammer elements such that a line coincident with the longitudinal axis of each said hammer element extends through said rotatable rotor drive shaft whereby the outer end of each said hammer element engages pallets in said entry portion to shred and chip such pallets entering said rotor housing and discharges the reduced material from said exit portion, each said circular rotor disc is mounted on said rotatable rotor drive shaft by a corresponding mounting collar having a centrally disposed aperture formed therethrough to receive said rotatable rotor drive shaft, each said mounting collar comprises a mounting element affixed within a corresponding centrally disposed rotor disc aperture and a spacer element having a width slightly greater than the width of said hammer elements.

21. The hammer mill apparatus of claim 20 wherein said rotor disc assemblies are maintained in operative alignment relative to each other by a key affixed within a slot formed on said rotatable rotor drive shaft extending through key ways formed in the periphery of said spacer elements to cooperatively form a rotor disc alignment means.

22. The hammer mill apparatus of claim 21 wherein said hammer elements of adjacent rotor disc assemblies are off-set relative to each other.

* * * * *